US010981744B2

(12) United States Patent
Yamada et al.

(10) Patent No.: US 10,981,744 B2
(45) Date of Patent: Apr. 20, 2021

(54) IMAGE FORMING APPARATUS

(71) Applicant: KYOCERA Document Solutions Inc., Osaka (JP)

(72) Inventors: Masayuki Yamada, Osaka (JP); Yoshifumi Okauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/785,514

(22) Filed: Feb. 7, 2020

(65) Prior Publication Data

US 2020/0262672 A1 Aug. 20, 2020

(30) Foreign Application Priority Data

Feb. 19, 2019 (JP) ..... JP2019-027748

(51) Int. Cl.
*B65H 31/26* (2006.01)
*B41J 13/00* (2006.01)
*G03G 15/00* (2006.01)

(52) U.S. Cl.
CPC ..... *B65H 31/26* (2013.01); *B41J 13/0045* (2013.01); *G03G 15/6547* (2013.01)

(58) Field of Classification Search
CPC ..... B65H 31/26; B65H 31/34; B65H 31/02; B65H 2405/114; B65H 2405/11425; B65H 2405/1142; B41J 13/0045; G03G 15/6547
USPC ..... 414/791.2; 271/220, 221, 222, 223, 224, 271/171
See application file for complete search history.

(56) References Cited

U.S. PATENT DOCUMENTS 4,603,542 A * 8/1986 Reiter ..... B65B 27/083 100/9
6,480,697 B2 * 11/2002 Kojima ..... B65H 29/14 271/184
6,505,830 B2 * 1/2003 Kang ..... B41J 11/0055 271/223
6,659,455 B2 * 12/2003 Endo ..... B42C 1/12 271/220
7,429,041 B2 * 9/2008 Yokoi ..... B65H 1/04 271/145
8,109,505 B2 * 2/2012 Shih ..... B65H 31/20 271/223

(Continued)

FOREIGN PATENT DOCUMENTS

JP 2004-272484 A 9/2004

*Primary Examiner* — Patrick H Mackey
(74) *Attorney, Agent, or Firm* — Studebaker & Brackett PC

(57) ABSTRACT

An image forming apparatus includes a stacking tray, a control unit, an alignment member and a supporting mechanism. The control unit performs a rotational sorting. An alignment member includes a leading end wall coming into contact with a leading edge of a portrait sheet stack, a pair of first side walls coming into contact with both side edges of the portrait sheet stack and a leading edge of a landscape sheet stack, and a pair of second side walls coming into contact with both side edges of the landscape sheet stack and aligning the portrait sheet stack and the landscape sheet stack. The supporting mechanism supports the alignment member so as to be movable in an alignment position where the alignment member protrudes from an upper face of the stacking tray and in a retracting position where the alignment member retracts from the upper face of the stacking tray.

6 Claims, 4 Drawing Sheets

(56) References Cited

U.S. PATENT DOCUMENTS

| | | | | |
|---|---|---|---|---|
| 9,738,480 | B2 * | 8/2017 | Ito | B65H 31/02 |
| 2012/0025442 | A1 * | 2/2012 | Naraoka | B65H 31/34<br>270/58.12 |

* cited by examiner

IMAGE FORMING APPARATUS

INCORPORATION BY REFERENCE

This application is based on and claims the benefit of priority from Japanese patent application No. 2019-027748 filed on Feb. 19, 2019, which is incorporated by reference in its entirety.

BACKGROUND

The present disclosure relates to an image forming apparatus having a function to switch a sheet discharge posture.

An image forming apparatus sometimes has a function to switch a discharge posture of a sheet alternately into a portrait posture and a landscape posture by each job unit (a rotational sorting function). By providing such a function, the sheets are stacked alternately in the portrait posture and the landscape posture by each job unit so that it becomes easy to sort the sheet stacks.

However, in order to improve an alignment of the sheet stacks, a mechanism to draw the sheet stacks or a width alignment mechanism is required. In particular, when the sheet stacks are aligned while performing the above sorting, the complicated structure is required. Then, increase in size and cost of the apparatus is caused. Alternatively, an option device to align the sheet stacks at the rotational sorting may be equipped.

SUMMARY

In accordance with an aspect of the present disclosure, an image forming apparatus includes a stacking tray, a control unit, an alignment member and a supporting mechanism. On the stacking tray, a sheet discharged in a predetermined discharge direction is stacked. The control unit performs a rotational sorting in which the sheets stacked on the stacking tray are sorted into a portrait sheet stack and a landscape sheet stack by alternately switching orientation of the sheets and discharging the sheets. The alignment member includes a leading end wall coming into contact with a leading edge of the portrait sheet stack, a pair of first side walls coming into contact with both side edges of the portrait sheet stack and a leading edge of the landscape sheet stack, and a pair of second side walls coming into contact with both side edges of the landscape sheet stack. The alignment member aligns the portrait sheet stack in a first stacking position on the stacking tray and the landscape sheet stack in a second stacking position on the stacking tray. The supporting mechanism supports the alignment member so as to be movable in an alignment position where the alignment member protrudes from an upper face of the stacking tray and in a retracting position where the alignment member retracts from the upper face of the stacking tray.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus according to one embodiment of the present disclosure will be described with reference to the drawings.

Figure 1:
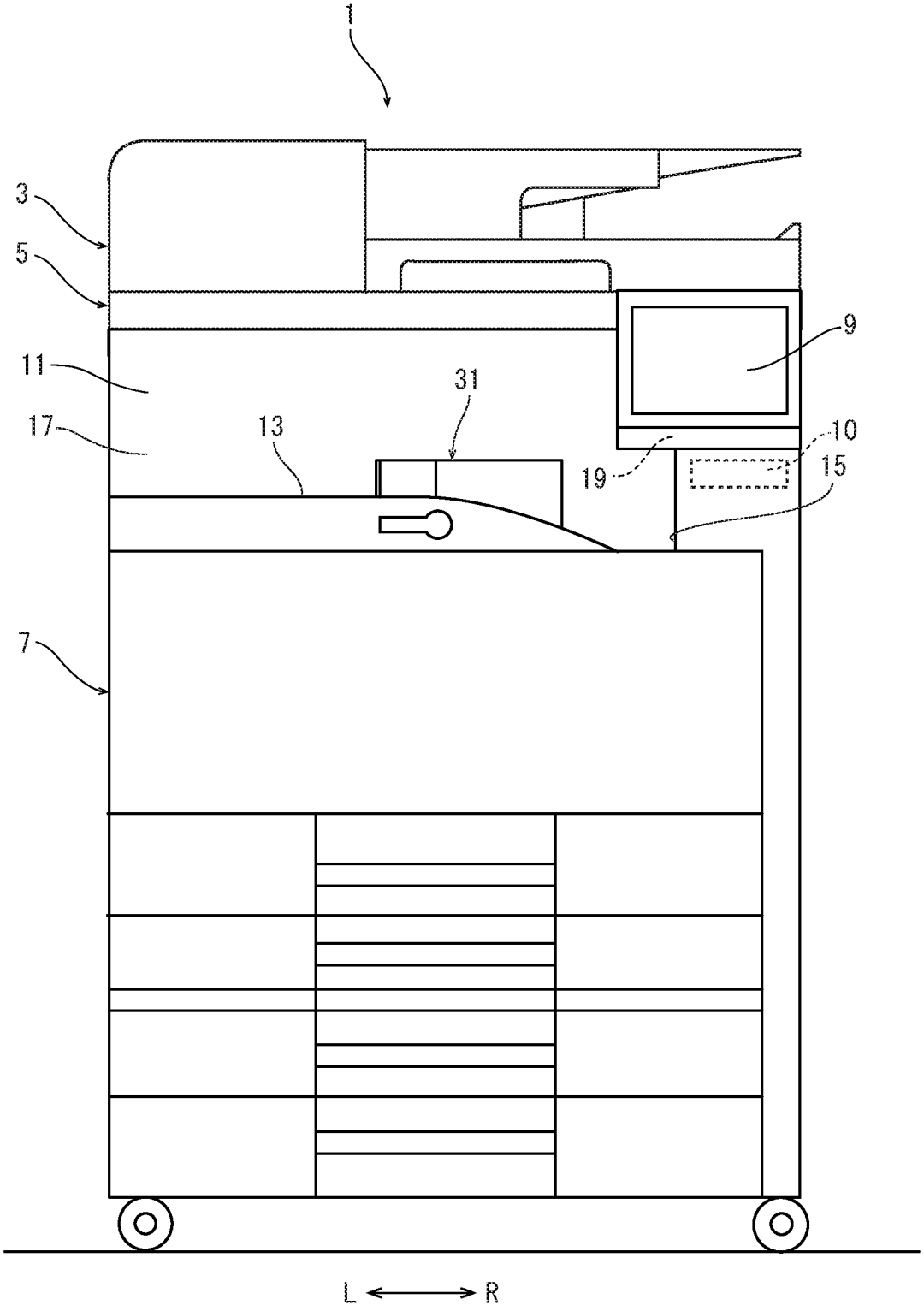
FIG. 1 is a front view showing an image forming apparatus according to one embodiment of the present disclosure.

Firstly, with reference to FIG. 1, an entire structure of the image forming apparatus will be described. FIG. 1 is a front view schematically showing the image forming apparatus. In the following description, a near side (a front side) of a paper surface of FIG. 1 is defined to be a front side of the image forming apparatus. In each figure, Fr, Rr, L and R respectively show a front side, a rear side, a left side and a right side of the image forming apparatus.

The image forming apparatus 1 includes a document conveying part 3 which conveys a document, an image reading part 5 which reads an image of the document conveyed by the document conveying part 3 and an image forming part 7 which forms an image on a sheet based on the image read by the image reading part 5. The image reading part 5 is disposed above the image forming part 7, and the document conveying part 3 is disposed above the image reading part 5. The image forming part 7 is provided with an operation panel 9 by which an operation accompanied with an image forming operation is inputted.

The image forming apparatus 1 includes a control unit 10 to perform a rotational sorting to switch the discharge posture (orientation) of a predetermined number of the sheets (A4 size, foe example) alternately into a first posture and into a second posture by each job unit and to sort the stacks of the predetermined number of the sheets. In the first posture, the sheet is discharged in a portrait posture (a posture where a longitudinal direction of the sheet is parallel to the discharge direction, in other words, a long side of the sheet is parallel to the discharge direction). In the second posture, the sheet is discharged in a landscape posture (a posture where a lateral direction of the sheet is parallel to the discharge direction, in other word, the short side of the sheet is parallel to the discharge direction). The rotational sorting is performed as follows, for example. Firstly, the A4 size sheets are stored in a first sheet feeding cassette in the portrait posture, and the A4 size sheets are stored in a second sheet feeding cassette in the landscape posture. The image forming part 7 forms a first image on a predetermined number of the sheets fed from the first sheet feeding cassette, and produces a sheet stack in the first posture (a portrait sheet stack). Then, the image forming part 7 forms a second image, obtained by rotating the first image by 90 degrees, on the predetermined number of the sheets fed from the second sheet feeding cassette, and produces a sheet stack in the second posture (a landscape sheet stack). The above processes are repeated alternately.

Between the image forming part 7 and the image reading part 5, an in-body sheet discharge space 11 is formed. The in-body sheet discharge space 11 is surrounded by the image reading part 5, a stacking tray 13 formed on the upper face of the image forming part 7, a right wall 15 formed between the image reading part 5 and the image forming part 7 and a rear wall 17. The in-body sheet discharge space 11 is opened to the front face and the left face. The right wall 15 is formed with a sheet discharge port 19 along a sheet width direction W crossing to a sheet discharge direction D.

Figure 2:
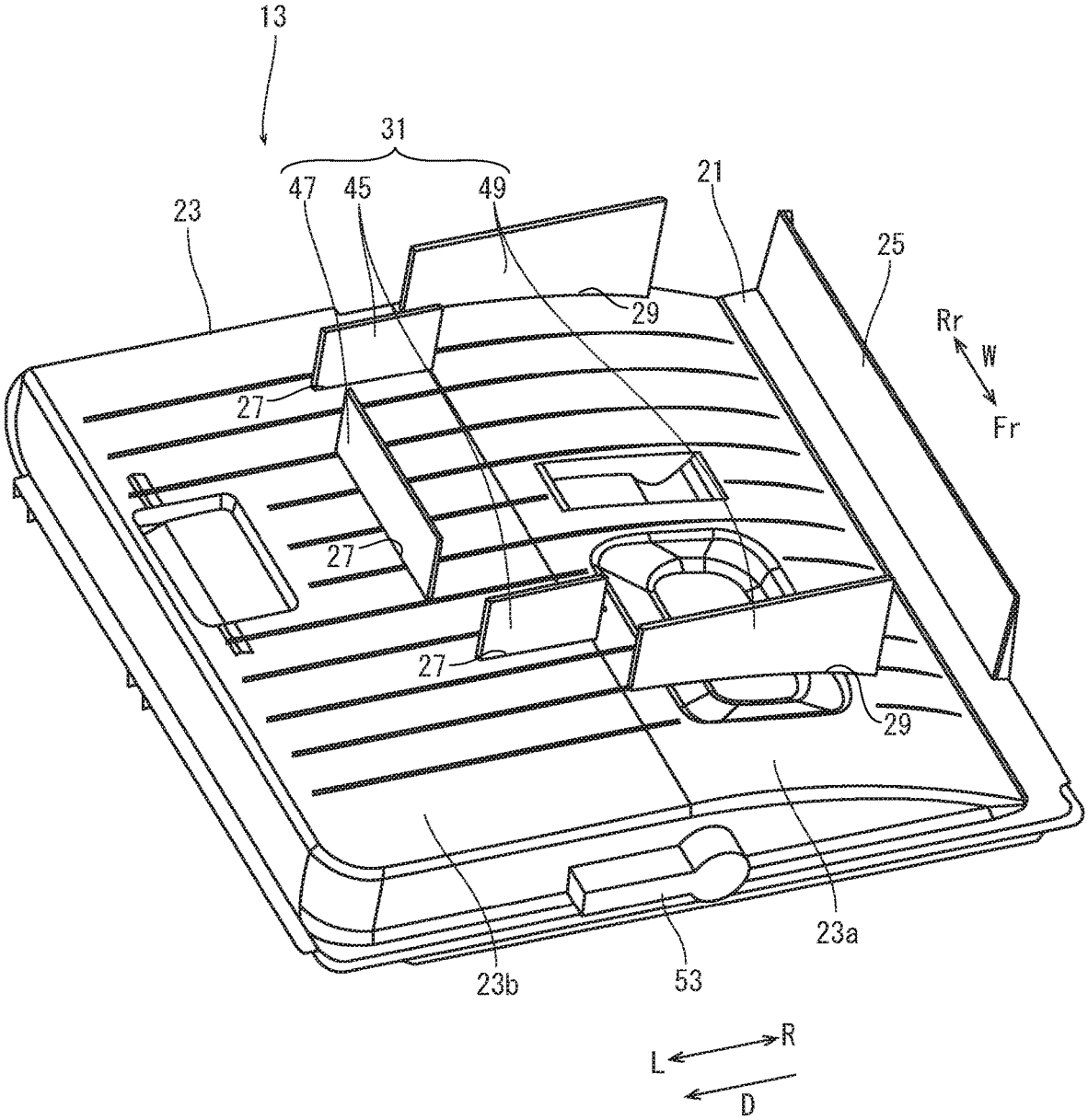
FIG. 2 is a perspective view showing a stacking tray of the image forming apparatus according to the embodiment of the present disclosure.
Figure 3:
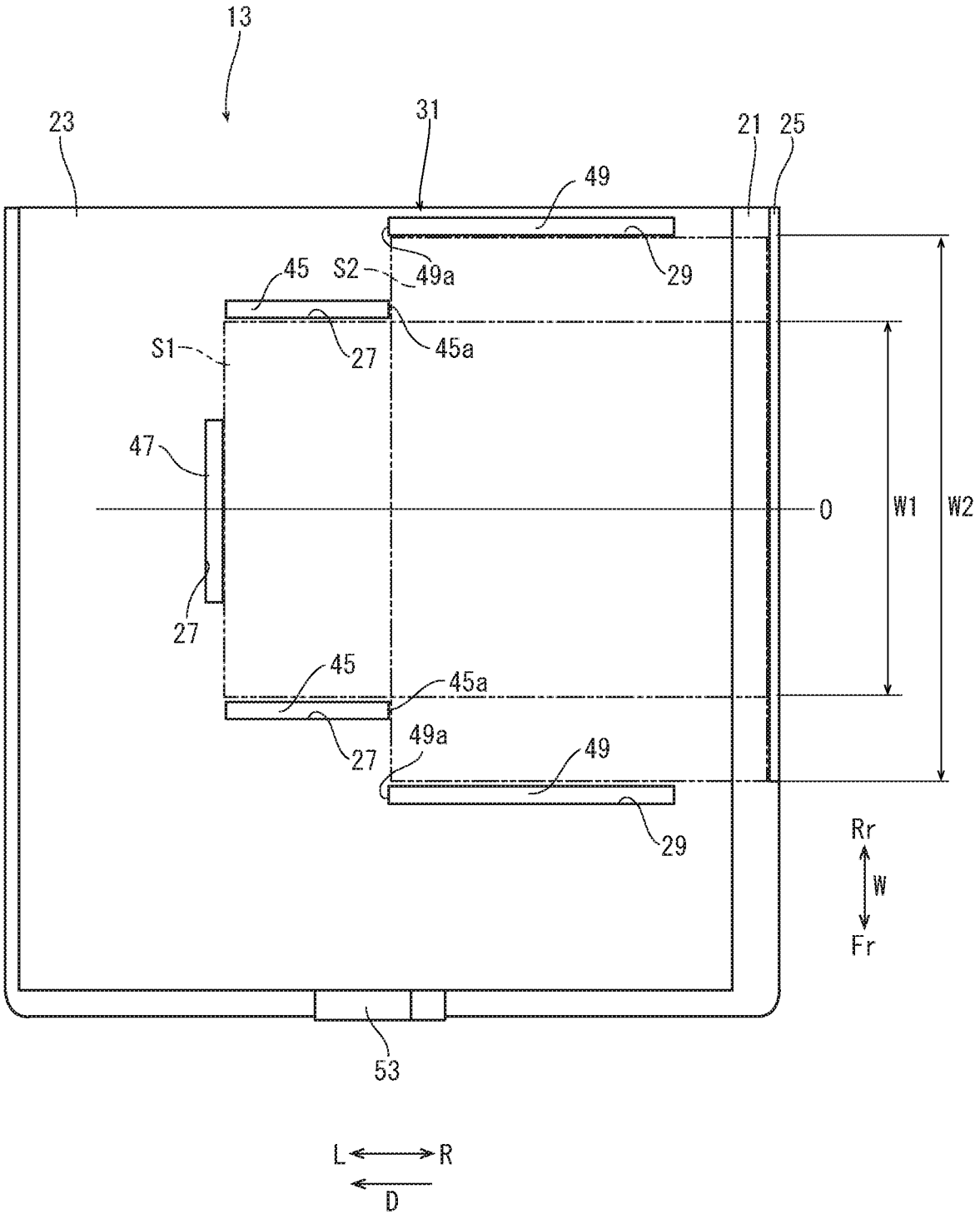
FIG. 3 is a plan view schematically showing the stacking tray of the image forming apparatus according to the embodiment of the present disclosure.

Next, with reference to FIG. 2 and FIG. 3, the stacking tray 13 will be described. FIG. 2 is a perspective view showing the stacking tray and FIG. 3 is a plan view schematically showing the stacking tray.

The stacking tray 13 has a base part 21, a stacking part 23 on which the discharged sheet is stacked and a trailing end wall 25 with which the trailing edge (the upstream side edge in the discharge direction D) of the sheet stacked on the stacking part 23 comes into contact. The base part 21 is formed into an approximately U-shaped frame whose rear side is opened in a plan view. The stacking part 23 is formed so as to rise upwardly from the inner edge of the base part 21, and has an inclined portion 23*a* and a horizontal portion 23*b* in the order along the discharge direction D. The inclined portion 23*a* is inclined upward to the downstream side, and the horizontal portion 23*b* is formed almost horizontally.

The horizontal portion 23*b* is formed with rectangular slits 27 which are formed along a part of the leading edge (the downstream side edge in the discharge direction) and a part of the side edges of the leading end portion (the downstream side end portion) of the sheet stacked on a first stacking position where the sheet discharged in the first posture is stacked. The inclined portion 23*a* is formed with rectangular slits 29 which are formed along a part of the side edges of the leading end portion (the downstream side end portion) of the sheet stacked on a second stacking position where the sheet discharged in the second posture is stacked. The trailing end wall 25 is formed along the width direction W on the trailing edge (the upstream side edge) of the base part 21. The trailing end wall 25 is slightly inclined upwardly to the upstream side in the discharge direction D.

The stacking tray 13 is provided with an alignment member 31. The alignment member 31 aligns the sheet stack in the first posture and the sheet stack in the second posture in the discharge direction D and in the width direction W on the stacking part 23 when the rotational sorting is performed. The alignment member 31 is supported by a supporting mechanism 33 (refer to FIG. 4A and FIG. 4B) disposed below the stacking tray 13. The supporting mechanism 33 supports the alignment member 31 in an alignment position and in a retracting position. In the alignment position (refer to FIG. 4A), the alignment member 31 protrudes upward from the upper face of the stacking part 23 and allows the alignment of the sheet stack of each posture. In the retracting position (refer to FIG. 4B), the alignment member 31 is retracted from the space above the stacking tray 13 and does not protrude upward from the upper face of the stacking part 23.

The alignment member 31 will be described. The alignment member 31 includes a leading end wall 47, a pair of first side walls 45 and a pair of second side walls 49. The leading end wall 47 comes into contact with a part of the leading edge of the leading end portion of the sheet in the first posture. The pair of first side walls 45 come into contact with a part of the side edges of the leading end portion of the sheet in the first posture and a part of the leading edge of the leading end portion of the sheet in the second posture. The pair of second side walls 49 come into contact with a part of the side edges of the leading end portion of the sheet in the second posture. The leading end wall 47, the pair of first side walls 45 and the pair of second side walls 49 are disposed in the order from the downstream side in the discharge direction D. Additionally, in the width direction W, the first side walls 45 are disposed outside the leading end wall 47, and the second side walls 49 are disposed outside the first side walls 45.

The first side walls 45 are each formed into a rectangular plate having a predetermined length along the discharge direction D and a predetermined width along the width direction W. The first side walls 45 are perpendicular to the stacking part 23 and parallel to the discharge direction D, and separated away at a predetermined distance W1 in the width direction W. The predetermined distance W1 is obtained by adding a predetermined length (5 to 10 mm, for example) to a length of the short side of a A4 size sheet.

The leading end wall 47 is formed into a rectangular plate having a predetermined length along the width direction W and a predetermined width along the discharge direction D. The leading end wall 47 is perpendicular to the stacking part 23 and parallel to the width direction W. A length of the leading end wall 47 in the width direction W is shorter than a distance between the first side walls 45 in the width direction W. That is, in the width direction W, between the leading end wall 47 and each of the first side walls 45, a predetermined gap is formed. The upper face of the leading end wall 47 and the upper faces of the first side walls 45 are on the same height position.

The second side walls 49 are each formed into a rectangular plate having a predetermined length along the discharge direction D and a predetermined width along the width direction W. The second side walls 49 are perpendicular to the stacking part 23 and parallel to the discharge direction D, and separated away at a predetermined distance W2 in the width direction W. The predetermined distance W2 is obtained by adding a predetermined length (5 to 10 mm, for example) to a length of the long side of a A4 size sheet. The downstream side end faces 49*a* of the second side walls 49 and the upstream side end faces 45*a* of the first side walls 45 are aligned on the same line along the width direction W. Between the second side walls 49 and the trailing end wall 25, a predetermined gap is formed. The upper faces of the second side walls 49 are on the same height position as that of the upper face of the leading end wall 47 and the upper faces of the first side walls 45.

As shown in FIG. 3, the leading end wall 47, the first side walls 45 and the second side walls 49 are disposed symmetrically with respect to a center line O along the discharge direction D.

Figure 4A:
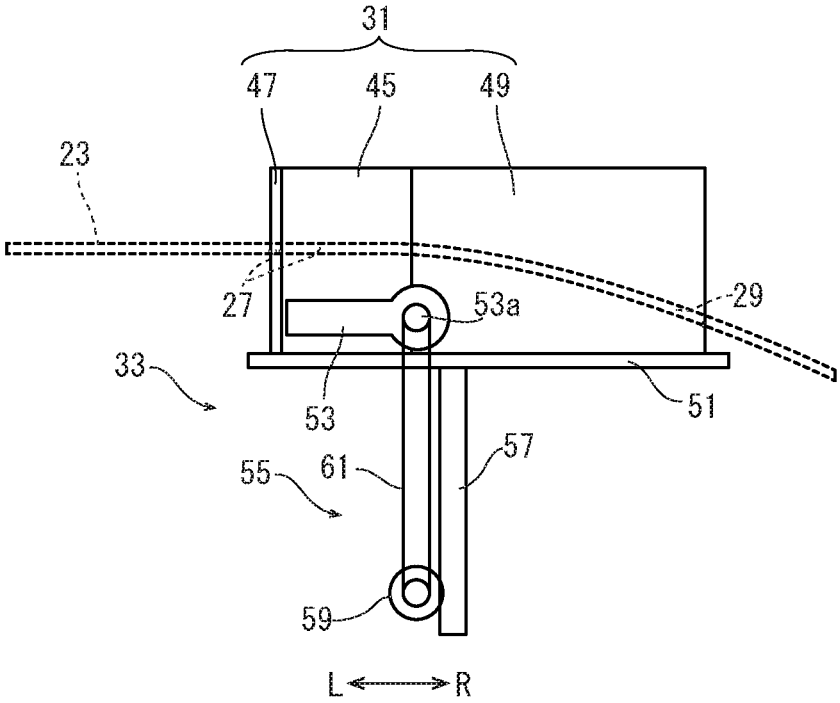
FIG. 4A is a front view schematically showing a supporting mechanism, in the image forming apparatus according to the embodiment of the present disclosure.
Figure 4B:
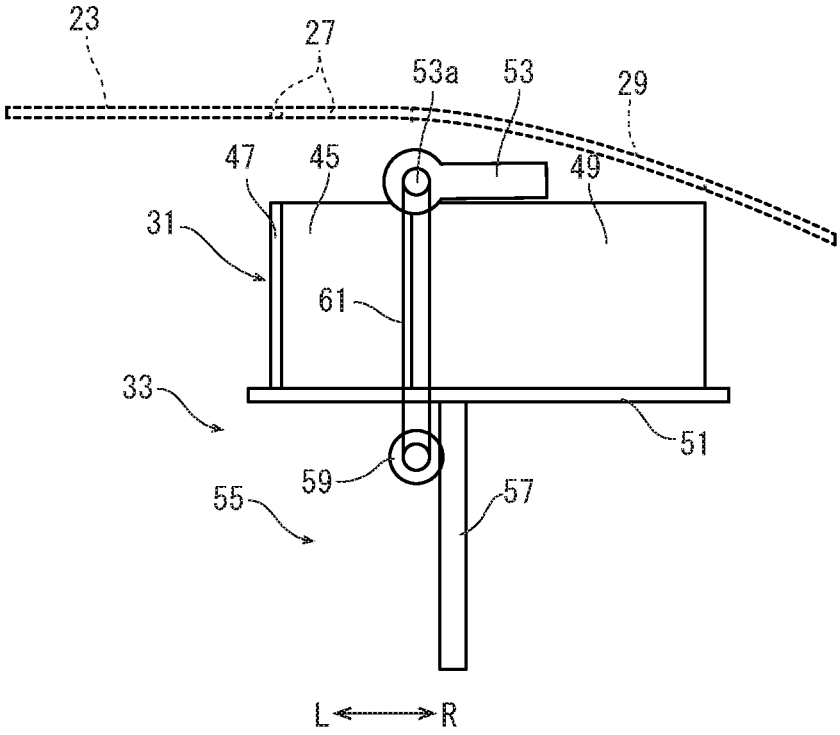
FIG. 4B is a front view schematically showing the supporting mechanism, in the image forming apparatus according to the embodiment of the present disclosure.

Next, with reference to FIG. 4A and FIG. 4B, the supporting mechanism 33 will be described. FIG. 4A and FIG. 4B are front views schematically showing the supporting mechanism.

The supporting mechanism 33 includes a base plate 51 which supports the alignment member 31, a lever 53 supported by the stacking tray 13 in a turnable manner, and a rack and pinion mechanism 55 as an elevating unit disposed between the base plate 51 and the lever 53.

On the base plate 51, the alignment member 31 (the leading end wall 47, the first side walls 45 and the second side walls 49) are fixed perpendicularly. The base plate 51 is supported in the space below the stacking tray 13 in an upwardly and downwardly movable manner along the upper-and-lower direction.

The lever 53 is supported on the front face of the stacking part 23 of the stacking tray 13 in a turnable manner around a rotational shaft 53*a* in a clockwise direction (a right direction) and a counterclockwise direction (a left direction).

The rack and pinion mechanism 55 has a rack gear 57 fixed on the lower face of the base plate 51 and a pinion gear 59 supported in a rotatable manner in the space below the stacking tray 13. The rack gear 57 is fixed on the lower face of the base plate 51 extending along the upper-and-lower direction. The pinion gear 59 is capable of being meshed with the rack gear 57, and connected to the rotational shaft 53*a* of the lever 53 via a timing belt 61. When the lever 53 is turned, the pinion gear 59 is rotated via the timing belt 61 and the rack gear 57 is thus moved along the upper-and-lower direction to move the base plate 51 upwardly and downwardly. As a result, the alignment member 31 is moved upwardly and downwardly through the slits 27 and 29 of the stacking part 23 between the alignment position (refer to FIG. 4A) where the alignment member 31 protrudes from the upper face of the stacking part 23 through the slits 27 and 29 of the stacking part 23 and the retracting position (refer to FIG. 4B) where they are retracted in the space below the stacking part 23.

In the image forming apparatus 1 having the above described configuration, when the rotational sorting is not performed, the lever 53 is rotated in a right direction. Then, as shown in FIG. 4B, the rack and pinion mechanism 55 move the alignment member 31 from the alignment position to the retracting position. That is, the alignment member 31 is retracted from the space above the stacking tray 13 so as not to interfere with the sheet discharged through the discharge port 19.

Additionally, as described above, the A4 size sheets are stored in the first sheet feeding cassette in the portrait posture (the first posture), and the A4 size sheets are stored in the second sheet feeding cassette in the landscape posture (the second posture). When the rotational sorting is performed, the control unit 10 controls the image forming part 7 such that the first image is formed on the sheet fed from the first sheet feeding cassette, that is, the sheet fed with the first posture.

Additionally, when the rotational sorting is performed, the lever 53 is turned in the left direction. Then, as shown in FIG. 4A, the rack and pinion mechanism 55 moves the alignment member 31 upwardly from the retracting position to the alignment position. In detail, the leading end wall 47, the first side walls 45 and the second side walls 49 protrude perpendicularly from the upper face of the stacking part 23 of the stacking tray 13 through the slits 27 and 29 of the stacking part 23.

When the first sheet S1 on which the first image is formed is discharged through the discharge port 19 with the first posture, the sheet S1 (refer to FIG. 3) is fallen on the stacking part 23 while the leading edge, both the side edges and the trailing edge of the sheet S1 guided along the leading end wall 47, the first side walls 45 and the trailing end wall 25 respectively. The fallen sheet S1 is aligned in the discharge direction D and in the width direction W at the first stacking position surrounded by the leading end wall 47, the first side walls 45 and the trailing end wall 25. The second sheet S is aligned in the same manner as the first sheet S1, and stacked on the first sheet S1. When a predetermined number of the sheets S1 are discharged, a first sheet stack containing the predetermined number of the sheets S1 discharged in the first posture is produced.

Next, the control unit 10 controls the image forming part 7 such that the second image, which is obtained by rotating the first image by 90 degree, is formed on the sheet fed from the second sheet feeding cassette, that is, the sheet fed with the second posture. When the first sheet S2 on which the second image is formed is discharged through the discharge port 19 with the second posture, the sheet S2 (refer to FIG. 3) is fallen on the stacking part 23 while the leading edge, both the side edges and the trailing edge of the sheet guided along the first side walls 45 (the upstream side end faces 45*a*), the second side walls 49 and the trailing end wall 25 respectively. The fallen sheet S1 is aligned in the discharge direction D and in the width direction W at the second stacking position surrounded by the first side walls 45, the second side walls 49 and the trailing end wall 25. The second sheet S2 is aligned in the same manner as the first sheet S2, and stacked on the first sheet S2. When a predetermined number of the sheets S2 are discharged, a first sheet stack containing the predetermined number of the sheets S2 discharged in the second posture is produced.

Then, the sheet stack in the first posture (the portrait sheet stack) and the sheet stack in the second posture (the landscape sheet stack) are alternatively stacked on the stacking part 23. After a predetermined number of the sheet stacks are formed, the lever 53 is turned in the right direction. As a result, the alignment member 31 is moved downwardly from the alignment position to the retracting position. Then, the stacked sheet stacks are removed from the stacking part 23.

As described above, in the image forming apparatus 1 of the present disclosure, by moving the alignment member 31 upwardly to the alignment position by the supporting mechanism 33, it becomes possible to align the sheet stacks in the first posture and the sheet stacks in the second posture in the discharge direction D and in the width direction W. Accordingly, it becomes possible to improve an alignment of the sheet stacks by a simple and inexpensive structure and to effectively perform the sorting work of the sheet stacks in the first posture and the sheet stacks in the second posture. Additionally, when the rotational sorting is not performed, the alignment member 31 is moved downwardly in the retracting position so as not to interfere with the discharged sheet.

Additionally, the alignment member 31 is moved upwardly and downwardly to the alignment position and the retracting position by turning the lever 53, so that it becomes possible to improve an alignment of the sheet stacks by a simple work. However, except for the configuration to turn the lever 53 manually, the alignment member 31 may be automatically moved to the alignment position and the retracting position. In this case, the operation panel 9 of the image forming apparatus 1 has an alignment mode in which the above alignment is performed. Then, when the alignment mode is selected by the operation panel 9, the pinion gear 59 of the rack and pinon mechanism 55 is rotated in the predetermined direction to move the alignment member 31 from the retracting position to the alignment position.

Additionally, the alignment member 31 is formed symmetrically with respect to the center line O along the discharge direction D, so that it becomes possible to sort the sheet stacks in the first posture and the sheet stacks in the second posture separately.

Additionally, the leading edge of the sheet in the second posture is guided along the upstream side end faces 45*a* of the first side walls 45 to align the sheet in the second posture in the discharge direction D. Therefore, it is not required to provide a leading end wall along which the leading edge of the sheet in the second posture is guided. Therefore, the alignment member 31 can have a simple structure. However, the leading end wall along which the leading edge of the sheet in the second posture is guided may be provided independently.

Next, a modified example of the alignment member 31 will be described. The leading end wall 47, the first side walls 45 and the second side walls 49 may be supported on the stacking part 23 of the stacking tray 13 in a foldable manner. In this case, on the stacking part 23, recesses into which the leading end wall 47, the first side walls 45 and the second side walls 49 are stored are formed. Then, the leading end wall 47, the first side walls 45 and the second side walls 49 are supported in the respective recesses in a turnable manner into the alignment position where they protrude upright from the respective recesses and the retracting position where they are stored in the respective recesses.

When the rotational sorting is not performed, the leading end wall 47, the first side walls 45 and the second side walls 49 are turned into the retracting posture to retract them from the space above the stacking part 23. As a result, the alignment member 31 does not interfere with the discharged sheet. When the rotational sorting is performed, the first side walls 45 and the second side walls 49 are turned into the alignment posture to align the sheet stack in the first posture and the sheet stack in the second posture in the same manner as described above. In the modified example, it becomes possible to achieve a simple structure and space saving.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a stacking tray on which a sheet discharged in a predetermined discharge direction is stacked;

a control unit which performs a rotational sorting in which the sheets stacked on the stacking tray are sorted into a portrait sheet stack and a landscape sheet stack by alternately switching orientation of the sheets and discharging the sheets;

an alignment member including a leading end wall coming into contact with a leading edge of the portrait sheet stack, a pair of first side walls coming into contact with both side edges of the portrait sheet stack and a leading edge of the landscape sheet stack, and a pair of second side walls coming into contact with both side edges of the landscape sheet stack and aligning the portrait sheet stack in a first stacking position on the stacking tray and the landscape sheet stack in a second stacking position on the stacking tray; and a supporting mechanism which supports the alignment member so as to be movable in an alignment position where the alignment member protrudes from an upper face of the stacking tray and in a retracting position where the alignment member retracts from the upper face of the stacking tray.

2. The image forming apparatus according to claim 1, wherein the stacking tray includes a trailing end wall coming into contact with a trailing edge of the sheet stack, the first stacking position is a region surrounded by the leading end wall, the pair of first side walls and the trailing end wall, and the second stacking position is a region surrounded by the pair of first side walls, the pair of second side walls and the trailing end wall.

3. The image forming apparatus according to claim 1, wherein the pair of first side walls is disposed symmetrically with respect to a center line along the discharge direction.

4. The image forming apparatus according claim 3, wherein a distance between the pair of first side walls is longer than a length of the leading end wall in a width direction perpendicular to the discharge direction.

5. The image forming apparatus according to claim 1, wherein the stacking tray has a slit through which the alignment member can pass, the supporting mechanism includes:

a base plate on which the alignment member is perpendicularly supported; and an elevating unit to move the base plate upwardly and downwardly, wherein when the elevating unit moves the base plate upwardly, the alignment member is passed through the slit and moved to the alignment position from the retracting position below the stacking tray, and when the elevating unit moves the base plate downwardly from the alignment position, the alignment member is passed through the slit and moved to the retracting position.

6. The image forming apparatus according to claim 5, wherein the supporting mechanism includes a lever supported by the stacking tray in a turnable manner, the elevating unit is a rack and pinion mechanism disposed between the lever and the base plate, and the rack and pinion mechanism converts a turning movement of the lever into an upwardly and downwardly movement of the base plate, wherein when the lever is turned in one direction, the alignment member is moved upwardly from the retracting position to the alignment position by the elevating unit, and when the lever is turned in the other direction, the alignment member is moved downwardly from the alignment position to the retracting position by the elevating unit.

* * * * *